US008640492B2

(12) United States Patent
Bahar

(10) Patent No.: US 8,640,492 B2
(45) Date of Patent: Feb. 4, 2014

(54) TUBULAR SYSTEM FOR ELECTROCHEMICAL COMPRESSOR

(75) Inventor: Bamdad Bahar, Chester, MD (US)

(73) Assignee: Xergy Inc, Georgetown, DE (US)

( * ) Notice: Subject to any disclaimer, the term of this patent is extended or adjusted under 35 U.S.C. 154(b) by 950 days.

(21) Appl. No.: 12/768,421

(22) Filed: Apr. 27, 2010

(65) Prior Publication Data

US 2011/0108246 A1 May 12, 2011

Related U.S. Application Data

(60) Provisional application No. 61/215,131, filed on May 1, 2009.

(51) Int. Cl.

| | |
|---|---|
| ***F25B 1/06*** | (2006.01) |
| ***F25B 23/00*** | (2006.01) |
| ***F04B 37/02*** | (2006.01) |
| ***C25B 9/00*** | (2006.01) |

(52) U.S. Cl.
USPC ..... 62/500; 62/467; 417/48; 204/266

(58) Field of Classification Search
USPC ..... 62/115, 238.2, 238.6, 500; 204/266; 205/765; 417/48
See application file for complete search history.

(56) References Cited

U.S. PATENT DOCUMENTS

| | | | | |
|---|---|---|---|---|
| 1,952,281 | A | | 3/1934 | Ranque |
| 2,913,511 | A | | 11/1959 | Grubb, Jr. |
| 2,920,457 | A | * | 1/1960 | Bartlett, Jr. ..... 62/5 |
| 3,432,355 | A | | 3/1969 | Niedrach et al. |
| 3,489,670 | A | | 1/1970 | Maget |
| 4,118,299 | A | | 10/1978 | Maget |
| 4,523,635 | A | | 6/1985 | Nishizaki et al. |
| 4,593,534 | A | | 6/1986 | Bloomfield |
| 4,671,080 | A | | 6/1987 | Gross |

(Continued)

FOREIGN PATENT DOCUMENTS

| | | |
|---|---|---|
| WO | 0125700 | 4/2001 |
| WO | 2008007108 A1 | 1/2008 |

OTHER PUBLICATIONS

"From Maget to Today," David Bloomfield, presented at a local meeting of the American Institute of Chemical Engineers (AIChE) in Boston, MA on Oct. 31, 2002, 26 pages.

(Continued)

*Primary Examiner* — Brandon M Rosati
*Assistant Examiner* — Elizabeth Martin
(74) *Attorney, Agent, or Firm* — Invention To Patent Services; Alex R Hobson

(57) ABSTRACT

A heat transfer system defines a closed loop that contains a working fluid that is circulated through the closed loop. The heat transfer system includes an electrochemical compressor including one or more electrochemical cells electrically connected to each other through a power supply. Each electrochemical cell includes a gas pervious anode, a gas pervious cathode, and an electrolytic membrane disposed between and in intimate electrical contact with the cathode and the anode. The heat transfer system also includes a tubular system that receives at least one electrochemically-active component of the working fluid from an output of the electrochemical compressor and, if present, other components of the working fluid that bypass the electrochemical compressor. The tubular system has a geometry that enables at least a portion of the received working fluid to be imparted with a gain in kinetic energy as it moves through the tubular system.

27 Claims, 7 Drawing Sheets

(56) References Cited

U.S. PATENT DOCUMENTS

| | | | | |
|---|---|---|---|---|
| 4,829,785 | A | 5/1989 | Hersey | |
| 5,024,060 | A | 6/1991 | Trusch | |
| 5,523,181 | A | 6/1996 | Stonehart et al. | |
| 5,547,551 | A | 8/1996 | Bahar et al. | |
| 5,599,614 | A | 2/1997 | Bahar et al. | |
| 5,635,041 | A | 6/1997 | Bahar et al. | |
| 5,746,064 | A | 5/1998 | Tsenter | |
| 5,768,906 | A | 6/1998 | Tsenter | |
| 5,900,031 | A | 5/1999 | Bloomfield | |
| 5,976,724 | A | 11/1999 | Bloomfield | |
| 5,993,619 | A | 11/1999 | Bloomfield et al. | |
| 6,068,673 | A | 5/2000 | Bloomfield | |
| 6,167,721 | B1 | 1/2001 | Tsenter | |
| 6,242,135 | B1 | 6/2001 | Mushiake | |
| 6,254,978 | B1 | 7/2001 | Bahar et al. | |
| 6,321,561 | B1 | 11/2001 | Maget | |
| 6,425,440 | B1 | 7/2002 | Tsenter et al. | |
| 6,553,771 | B2 * | 4/2003 | Tsenter | 62/46.2 |
| 6,635,384 | B2 | 10/2003 | Bahar et al. | |
| 2002/0066277 | A1 | 6/2002 | Tsenter | |
| 2003/0196893 | A1 * | 10/2003 | McElroy et al. | 204/266 |
| 2006/0230765 | A1 * | 10/2006 | Fedorov et al. | 62/5 |
| 2006/0254286 | A1 | 11/2006 | Johnson et al. | |
| 2008/0187794 | A1 * | 8/2008 | Weingaertner et al. | 429/14 |

OTHER PUBLICATIONS

International Search Report issued by Lee Choong Seok of the Korean Intellectual Property Office for the corresponding application PCT/US2010/032731 on Jan. 3, 2011, 3 sheets.

Written Opinion issued by Lee Choong Seok of the Korean Intellectual Property Office for the corresponding application PCT/US2010/032731 on Jan. 3, 2011, 3 sheets.

"Engineering a Membrane Electrode Assembly," John W. Weidner et al., The Electrochemical Society Interface, Winter, 2003, pp. 40-43.

Technical Specifications for "HOGEN Hydrogen Generation Systems," Proton Energy Systems, Inc., Oct. 2008, 2 pages.

"Teledyne Titan(TM) HM Generator Series Hydrogen/Oxygen Gas Systems," Teledyne Energy Systems, Inc., Jun. 2007, 2 pages.

Ali Kilicarslan et al., "A comparative study of water as a refrigerant with some current refrigerants," Int. J. Energy Res. 2005; 29:947-959. Published online Jul. 18, 2005 in Wiley InterScience (www.interscience.wiley.com).

* cited by examiner

TUBULAR SYSTEM FOR ELECTROCHEMICAL COMPRESSOR

CROSS-REFERENCE TO RELATED APPLICATION

This application claims priority to U.S. Application No. 61/215,131, filed on May 1, 2009 and entitled "Tubular Accessory for Electrochemical Compressor and Heat Pump System," which is incorporated herein by reference in its entirety.

TECHNICAL FIELD

The disclosed subject matter relates to a tubular system at an output of an electrochemical compressor of a heat transfer system such as a refrigeration system.

BACKGROUND

The function of both refrigeration cycles and heat pumps is to remove heat from a heat source or reservoir at low temperature and to reject the heat to a heat sink or reservoir at high temperature. While many thermodynamic effects have been exploited in the development of heat pumps and refrigeration cycles, one of the most popular today is the vapor compression approach. This approach is sometimes called mechanical refrigeration because a mechanical compressor is used in the cycle.

Mechanical compressors account for approximately 30% of a household's energy requirements and thus consume a substantial portion of most utilities' base load power. Any improvement in efficiency related to compressor performance can have significant benefits in terms of energy savings and thus have significant positive environmental impact. In addition, there are increasing thermal management problems in electronic circuits, which require smaller heat pumping devices with greater thermal management capabilities.

Vapor compression refrigeration cycles generally contain five important components. The first is a mechanical compressor that is used to pressurize a gaseous working fluid. After proceeding through the compressor, the hot pressurized working fluid is condensed in a condenser. The latent heat of vaporization of the working fluid is given up to a high temperature reservoir often called the sink. The liquefied working fluid is then expanded at substantially constant enthalpy in a thermal expansion valve or orifice. The cooled liquid working fluid is then passed through an evaporator. In the evaporator, the working fluid absorbs its latent heat of vaporization from a low temperature reservoir often called a source. The last element in the vapor compression refrigeration cycle is the working fluid itself.

In conventional vapor compression cycles, the working fluid selection is based on the properties of the fluid and the temperatures of the heat source and sink. The factors in the selection include the specific heat of the working fluid, its latent heat of vaporization, its specific volume and its safety. The selection of the working fluid affects the coefficient of performance of the cycle.

For a refrigeration cycle operating between a lower limit, or source temperature, and an upper limit, or sink temperature, the maximum efficiency of the cycle is limited to the Carnot efficiency. The efficiency of a refrigeration cycle is generally defined by its coefficient of performance, which is the quotient of the heat absorbed from the sink divided by the net work input required by the cycle.

SUMMARY

In some general aspects, a heat transfer system defines a closed loop that contains a working fluid that is circulated through the closed loop. The heat transfer system includes an electrochemical compressor including one or more electrochemical cells electrically connected to each other through a power supply, each electrochemical cell having a gas pervious anode, a gas pervious cathode, and an electrolytic membrane disposed between and in intimate electrical contact with the cathode and the anode. The heat transfer system also includes a tubular system that receives at least one electrochemically-active component of the working fluid from an output of the electrochemical compressor and, if present, other components of the working fluid that bypass the electrochemical compressor. The tubular system has a geometry that enables at least a portion of the received working fluid to be imparted with a gain in kinetic energy as it moves through the tubular system.

Implementations can include one or more of the following features. For example, the tubular system can be configured to prevent the working fluid portion from flowing back into the electrochemical compressor.

The heat transfer system can include a first heat transfer device that transfers heat from a first heat reservoir to the working fluid; and a second heat transfer device that transfers heat from the working fluid to a second heat reservoir. The first heat reservoir can be at a lower temperature than the second heat reservoir. The electrochemical compressor can be between the first and second heat transfer devices. The first heat transfer device can include an evaporator and the second heat transfer device can include a condenser.

The heat transfer system can also include an expansion valve between the first and second heat transfer devices and configured to reduce a pressure of the working fluid.

The electrochemical compressor output can be a cathode output that receives the electrochemically-active component after it has been pressurized. The electrochemical compressor can include an anode at which the other working fluid components exit the electrochemical compressor without being pressurized. The tubular system can be configured to mix the un-pressured working fluid components (that is, the other working fluid components that exit the compressor without being pressurized) with the pressurized electrochemically-active component. The tubular system can be configured to transfer kinetic energy from the pressurized electrochemically-active component to the un-pressured working fluid components.

The other working fluid components can include a condensable refrigerant component that bypasses the electrochemical process.

The heat transfer system can include a heat sink in thermal contact with the tubular system.

The tubular system can include a venturi tube. The tubular system can include a vortex tube. The tubular system can be configured to receive all of the components of the working fluid from the electrochemical compressor.

In other general aspects, heat is transferred using a working fluid that is circulated through and contained within a closed loop. A pressure of at least one electrochemically-active component of the working fluid is increased by circulating the electrochemically-active component through an electrochemical compressor and outputting the pressurized electrochemically-active component. The working fluid including the pressurized electrochemically-active component and, if present, other components of the working fluid that bypass the electrochemical compressor are outputted. A gain in kinetic energy is imparted to at least a portion of the outputted working fluid by directing the outputted working fluid through a body of revolution.

Implementations can include one or more of the following features. For example, the pressure of the electrochemically-active working fluid component can be increased by electrochemically ionizing the electrochemically-active component by stripping charged particles from the electrochemically-active component, enabling the ionized electrochemically-active component to pass through an electrolytic membrane, pumping the charged particles to create an electric potential gradient across the electrolytic membrane, pumping the ionized electrochemically-active component across the electrolytic membrane using the electric potential gradient, electrochemically de-ionizing the electrochemically-active component by combining the pumped charged particles with the ionized electrochemically-active component, and pressuring the de-ionized electrochemically-active component.

The electrochemically-active component can be dissociated from a condensable refrigerant component within the working fluid to enable the condensable refrigerant component to bypass the electrochemical compressor.

Heat from a first heat reservoir at a relatively low temperature can be conveyed to a second heat reservoir at relatively high temperature by circulating the working fluid through a closed loop that is thermally coupled to the first heat reservoir at a first portion and is thermally coupled to the second heat reservoir at a second portion. The heat can be conveyed by transferring heat from the working fluid at the second loop portion to the second heat reservoir including liquefying at least some of the working fluid; reducing a pressure of the at least partially liquefied working fluid by expanding the working fluid at a substantially constant enthalpy; and transferring heat from the first heat reservoir to the working fluid at the first loop portion including vaporizing at least some of the working fluid.

If other working component components that bypass the electrochemical compressor are present, then the pressurized electrochemically-active component can be re-associated with the condensable refrigerant component by imparting the gain in kinetic energy to the outputted working fluid portion to form a pressurized working fluid.

The gain in kinetic energy can be imparted to the outputted working fluid portion by reducing an amount of working fluid from flowing back into the electrochemical compressor.

If other components of the working fluid that bypass the electrochemical compressor are present, then the pressurized electrochemically-active component can be mixed with the other components.

If other components of the working fluid that bypass the electrochemical compressor are present, then kinetic energy can be imparted to the outputted working fluid portion by transferring kinetic energy from the pressurized electrochemically-active component to the other components.

The gain in kinetic energy can be imparted to the outputted working fluid portion by directing the outputted working fluid through a Venturi tube. The gain in kinetic energy can be imparted to the outputted working fluid portion by directing the outputted working fluid through a vortex tube.

The electrochemically-active component can include hydrogen ($H_2$) and the condensable refrigerant component can include carbon dioxide ($CO_2$). The condensable refrigerant can lack water. The working fluid can include water.

An electrochemical compressor and heat pump system includes an electrochemical cell and a mixed gas refrigerant-based cooling system. The electrochemical cell is capable of producing high pressure hydrogen gas from a mixed fluid system including an electrochemically-active component such as hydrogen and at least one refrigerant fluid. The cooling system can include a condenser, compressor, and evaporator in thermal communication with an object to be cooled. Hydrogen gas is pressurized across the membrane electrode assembly. The hydrogen gas enters a gas space, where it is compressed into a vapor refrigerant. As the vapor refrigerant is compressed, it is forced through the condenser where the refrigerant is liquefied. The liquid refrigerant then passes through the evaporator where the liquid refrigerant is evaporated by absorbing heat from the object to be cooled. The mixed fluids then enter the electrochemical cell where hydrogen is pressurized again.

The electrochemical compressor raises the pressure of hydrogen in the working fluid and hydrogen back to the working fluid (refrigerant), which is then delivered to a condenser where the condensable component is precipitated by heat exchange with a sink fluid. The working fluid is then reduced in pressure in a thermal expansion valve. Subsequently, the low pressure working fluid is delivered to an evaporator where the condensed phase of the working fluid is boiled by heat exchange with a source fluid. The evaporator effluent working fluid may be partially in the gas phase and partially in the liquid phase when it is returned from the evaporator to the electrochemical compressor. In the process, heat energy is transported from the evaporator to the condenser and consequently, from the heat source at low temperature to the heat sink at high temperature.

One concern involving the use of electrochemical compressors is that the electrochemically-active component is reduced (such as for example to hydrogen gas from the cathode) at pressure, and then mixed with the working fluid at the anode, to raise the pressure of the working fluid. Remixing the gases creates the potential for blow back into the cells, and also requires good transfer of energy from the gas emerging from the cathode to the gas emerging from the anode. Thus the tubular system is used to reduce the potential for blow back and aid in good transfer of energy from one gas to the other. The tubular system is useful for mixing the pressurized hydrogen gas from the cathode of the electrochemical compressor cell with the working fluid (refrigerant) exiting the anode, and reduce the potential for blow back. Such a tubular system may also provide refrigeration or heating effects depending on specific applications.

Optionally, the working fluid may be pure hydrogen, and thus be completely transported to the cathode side, in which case a vortex tube maybe used with compressed hydrogen intake only.

The choice of tubular system is specific to the application of the heat transfer system, but nevertheless would be able to improve the gas stream(s) exiting the electrochemical compressor in preparation for the refrigeration cycles, and mitigate any negative impact (like blow back) into the cells of the compressor.

DRAWING DESCRIPTION

DESCRIPTION

Figure 1:
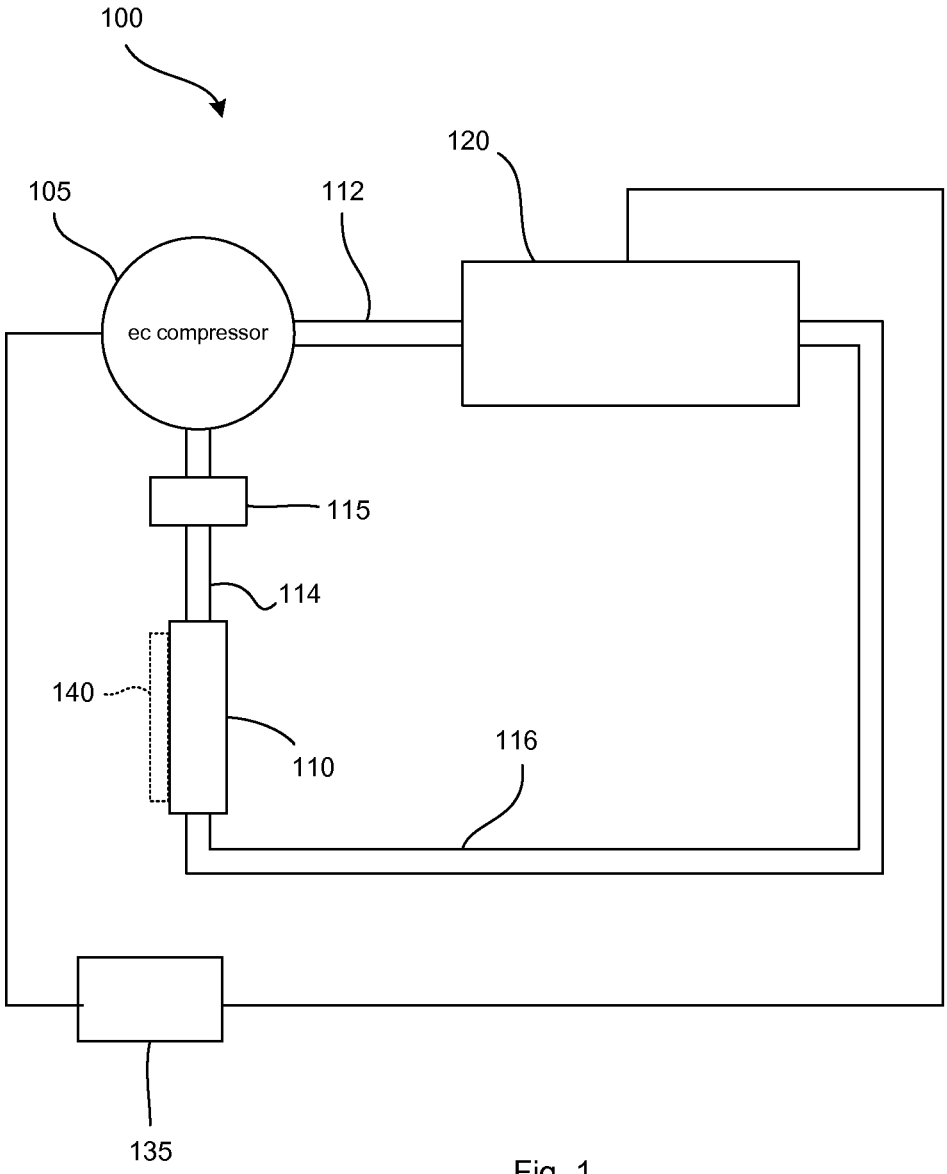
FIG. 1 is a block diagram of a heat transfer system that defines a closed loop that contains a working fluid and includes an electrochemical compressor.

Referring to FIG. 1, a heat transfer system 100 defines a closed loop that contains a working fluid that is circulated through the loop. The heat transfer system 100 includes an electrochemical compressor 105 that lacks moving parts and a tubular system 110 that receives at least a portion of the working fluid from an output 114 of the compressor 105. The tubular system 110 has a geometry of a body of revolution having a form described by rotating a plane curve about an axis in its plane. Due to this symmetrical geometry, a component of the working fluid portion is imparted with a gain in kinetic energy as that component moves through the tubular system 110. The tubular system 110 can additionally prevent or reduce the amount of the working fluid portion from flowing back into the compressor 105. For example, the tubular system 110 can be a venturi tube or a vortex tube, as discussed below. In some implementations, the heat transfer system 100 also includes a heat sink 140 in thermal contact with the tubular system 110.

The heat transfer system 100 can optionally include one or more output components 115 at the output 114 of the compressor 105. The output components 115 are one-way valves that ensure proper delivery of the working fluid components that exit the compressor 105 by reducing or avoiding back-pressure into the compressor 105 and therefore ensure unidirectional flow of fluids (including any gases). Moreover, the heat transfer system 100 includes heat transfer components 120 between an output 116 of the tubular system 110 and an input 112 of the compressor 105. These heat transfer components 120 are any components that are used to transfer heat from one location to another, and will be discussed in greater detail below.

Figure 2:
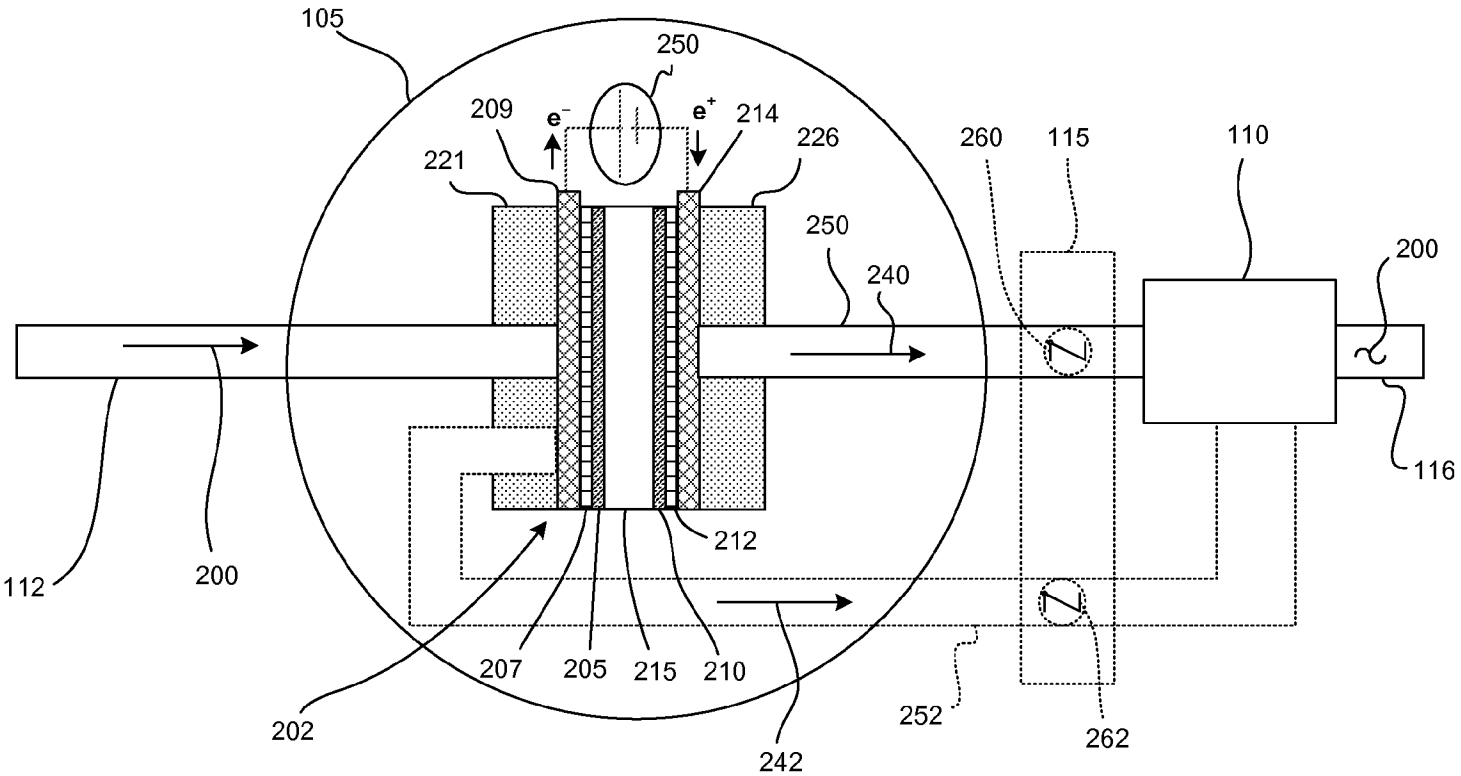
FIG. 2 is a block diagram of an exemplary electrochemical compressor used in the heat transfer system of FIG. 1.

Referring also to FIG. 2, the electrochemical compressor 105 is a device that raises the pressure of a component of the working fluid 200 by an electrochemical process. Accordingly, at least one component of the working fluid 200 must be electrochemically active. In particular, the electrochemically-active component must be ionizable. For example, the electrochemically-active component is oxidizable at a gas pervious anode 205 of the compressor 105 and is reducible at a gas pervious cathode 210 of the compressor 105. The electrochemical compressor 105 includes one or more electrochemical cells electrically connected to each other through a power supply, each electrochemical cell having a gas pervious anode, a gas pervious cathode, and an electrolytic membrane disposed between and in intimate electrical contact with the cathode and the anode. The design in which the compressor 105 includes only one exemplary cell 202 is shown in FIG. 2. However, the electrochemical compressor 105 can include a plurality of electrochemical cells, as shown in FIGS. 3A-C of U.S. application Ser. No. 12/626,416, filed Nov. 25, 2009 and entitled "Electrochemical Compressor and Refrigeration System," which is incorporated herein by reference in its entirety. In some implementations, the electrochemical compressor 105 is an annular stack of electrochemical cells electrically connected in series such as, for example, the cells generally described in U.S. Pat. No. 2,913,511 (Grubb); in U.S. Pat. No. 3,432,355 (Neidrach); and in U.S. Pat. No. 3,489,670 (Maget).

Each cell 202 includes the anode 205, where the electrochemically-active component of the working fluid is oxidized; the cathode 210, where the electrochemically-active component (EC) of the working fluid is reduced; and an electrolyte 215 that serves to conduct the ionic species ($EC^+$) from the anode 205 to the cathode 210. The electrolyte 215 can be an impermeable solid ion exchange membrane having a porous microstructure and an ion exchange material impregnated through the membrane such that the electrolyte 215 can withstand an appreciable pressure gradient between its anode and cathode sides. The examples provided here employ impermeable ion exchange membranes, and the electrochemically-active component of the working fluid is remixed with the working fluid after compression and thus the pressure of the working fluid 200 is elevated prior to the condensation phase of the refrigeration process. However, a permeable ion exchange membrane is also feasible with the working fluid traversing in a unidirectional and sequential path through electrode assemblies with increasing pressure. The active components of the working fluid dissolve into the ion exchange media of the ion exchange membrane and the gas in the working fluid traverses through the ion exchange membrane.

As another example, the electrolyte 215 can be made of a solid electrolyte, for example, a gel, that is, any solid, jelly-like material that can have properties ranging from soft and weak to hard and tough and being defined as a substantially dilute crosslinked system that exhibits no flow when in the steady-state. The solid electrolyte can be made very thin, for example, it can have a thickness of less than 0.2 mm, to provide additional strength to the gel. Alternatively, the solid electrolyte can have a thickness of less than 0.2 mm if it is reinforced with one or more reinforcing layers like a polytetrafluoroethylene (PTFE) membrane (having a thickness of about 0.04 mm or less) depending on the application and the ion exchange media of the electrolyte.

Each of the anode 205 and the cathode 210 can be an electrocatalyst such as platinum or palladium or any other suitable candidate catalyst. The electrolyte 215 can be a solid polymer electrolyte such as Nafion (trademark for an ion exchange membrane manufactured by the I. E. DuPont DeNemours Company) or GoreSelect (trademark for a composite ion exchange membrane manufactured by W.L. Gore & Associates Inc.). The catalysts (that is, the anode 205 and the cathode 210) are intimately bonded to each side of the electrolyte 215. The anode 205 includes an anode gas space (a gas diffusion media) 207 and the cathode 210 includes a cathode gas space (a gas diffusion media) 212. The electrodes (the anode 205 and the cathode 210) of the cell 202 can be considered as the electrocatalytic structure that is bonded to the solid electrolyte 215. The combination of the electrolyte 215 (which can be an ion exchange membrane) and the electrodes (the anode 205 and the cathode 210) is referred to as a membrane electrode assembly or MEA.

Adjacent the anode gas space 207 is an anode current collector 209 and adjacent the cathode gas space 212 is a cathode current collector 214. The anode collector 209 and the cathode collector 214 are electrically driven by the power supply 250. The anode collector 209 and the cathode collector 214 are porous, electronically conductive structures that can be woven metal screens (also available from Tech Etch) or woven carbon cloth or pressed carbon fiber or variations thereof. The pores in the current collectors 209, 214 serve to facilitate the flow of gases within the gas spaces 207, 212 adjacent to the respective electrodes 205, 210.

Outer surfaces of the collectors 209, 214 are connected to respective bipolar plates 221, 226 that provide fluid barriers that retain the gases within the cell 202. Additionally, if the cell 202 is provided in a stack of cells, then the bipolar plates 221, 226 separate the anode and cathode gases within each of the adjacent cells in the cell stack from each other and facilitate the conduction of electricity from one cell to the next cell in the cell stack of the compressor. The bipolar plate 221, 226 can be obtained from a number of suppliers including Tech Etch (Massachusetts).

Additionally, subassemblies of components of the electrochemical cell can be commercially obtained from manufacturers such as W.L. Gore & Associates Inc. under the PRIMEA trademark or Ion Power Inc. Commercially available assemblies are designed for oxygen reduction on one electrode and therefore the electrodes (the anode 205 and cathode 210) may need to be modified for hydrogen reduction.

Hydrogen reduction at the cathode 210 actually requires lower loadings of precious metal catalysts and also is feasible with alternative lower cost catalysts such as palladium. Thus, the eventual production costs of assemblies employed in the system 100 are substantially lower than typical fuel cell components.

The working fluid 200 includes one or more components, depending on the application of the heat transfer system 100. Thus, in some implementations, the working fluid 200 includes a first component that is electrochemically active, and therefore takes part in the electrochemical process within the compressor 105 such that the first component 240 is output along a conduit 250, and a second component 242 that is a condensable refrigerant that bypasses along a separate conduit 252 the electrochemical process within the compressor 105. Such a working fluid is described with reference to FIG. 3.

In other implementations, the working fluid 200 includes a single component (such as pure hydrogen ($H_2$)) that acts as a heat transfer fluid and is electrochemically active and entirely takes part in the electrochemical process. In these other implementations, there would be no second component that bypasses the compressor 105 along the conduit 252 and the single component 240 moves entirely within the conduit 250. Such a working fluid is described with reference to FIG. 6.

Referring again to FIG. 1, the heat transfer system 100 optionally includes one or more output components 115 at the output 114 of the compressor 105. The output components 115 can include a first one-way valve 260 in the conduit 250 that ensures proper delivery of the first working fluid component 240 that exits the compressor 105 and a second one-way valve 262 in the conduit 252 that ensures proper delivery of the second working fluid component 242.

The heat transfer system 100 also includes a control system 135 that is coupled to the compressor 105 and one or more devices within the heat transfer components 120. The control system 135 can be a general system including sub-components that perform distinct steps. For example, the control system 135 includes the power supply 250 (such as, for example, a battery, a rectifier, or other electric source) that supplies a direct current electric power to the compressor 105.

Moreover, the control system 135 includes one or more of digital electronic circuitry, computer hardware, firmware, and software. The control system 135 can also include appropriate input and output devices, a computer processor, and a computer program product tangibly embodied in a machine-readable storage device for execution by a programmable processor. The procedure embodying these techniques (discussed below) may be performed by a programmable processor executing a program of instructions to perform desired functions by operating on input data and generating appropriate output. Generally, a processor receives instructions and data from a read-only memory and/or a random access memory. Storage devices suitable for tangibly embodying computer program instructions and data include all forms of non-volatile memory, including, by way of example, semiconductor memory devices, such as EPROM, EEPROM, and flash memory devices; magnetic disks such as internal hard disks and removable disks; magneto-optical disks; and CD-ROM disks. Any of the foregoing may be supplemented by, or incorporated in, specially-designed ASICs (application-specific integrated circuits).

The control system 135 receives information from components (such as, for example, temperature sensors and the compressor 105) of the system 100 and controls operation of a procedure (as discussed below) that can either maintain a heat source or a heat sink at a relatively constant temperature condition. Additionally, controlling the operation of an electrochemical compressor 105 consists of turning its current on or off through the power supply. Alternatively, the voltage applied to the electrochemical compressor 105 can be set to be in proportion to the heat source fluid temperature or the heat sink fluid temperature. In some applications, such as electric cars without internal combustion engines, there may be an advantage in operating the vehicle air conditioning system electrically and driving each wheel independently without a central motor (required to drive the air conditioning system).

Figure 3:
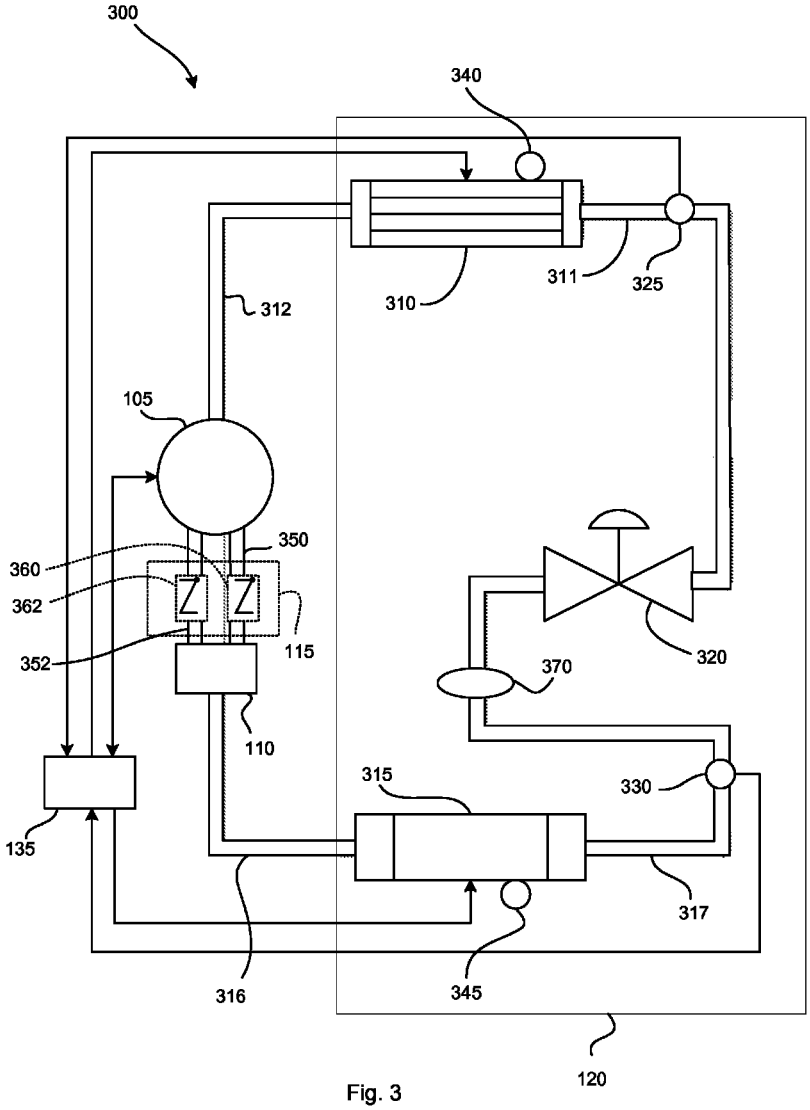
FIG. 3 is a block diagram of an exemplary heat transfer system of FIG. 1 that is a refrigeration system.

Referring to FIG. 3, an exemplary heat transfer system 300 that includes a compressor 105 and a tubular system 110 is shown. In this case, the heat transfer system 300 is a refrigeration system in which the heat transfer components 120 include a first heat transfer device 310 that transfers heat from a first heat reservoir (a heat source or object to be cooled) to the working fluid, a second heat transfer device 315 that transfers heat from the working fluid to a second heat reservoir (a heat sink), and a thermostatic expansion valve 320 between the first and second heat transfer devices. The system 300 also includes one or more sensors (for example, temperature sensors) 325, 330 placed along flow paths between components of the system 300 to provide feedback to the control system 135, which is also coupled to the compressor 105, the first heat transfer device 310, and the second heat transfer device 315.

The working fluid contained within the closed loop of the system 300 includes at least the first component 240 that is electrochemically active and therefore takes part in the electrochemical process within the compressor 105. The first component 240 is output along the conduit 350. The working fluid includes at least the second component 242 that is a condensable refrigerant that can be used for the heat transfer application under consideration. The condensable refrigerant is any suitable condensable composition that does not include water. The condensable refrigerant bypasses the electrochemical process within the compressor 105. The second component 242 is output along the conduit 352. As discussed above, each of the conduits 350, 352 can include a respective one-way valve 360, 362 that ensures proper delivery of the respective working fluid components 240, 242.

Additionally, the working fluid can include a third component (such as water) to hydrate an ion exchange membrane within the compressor 105 and therefore pass through the compressor 105 with the first component 240. Water can be considered a contaminant of some standard refrigerants, and it can negatively impact heat exchange performance of the refrigerant. Thus water as the third component of the working fluid can be reduced for example, to a minimal amount that is needed to provide enough hydration to one or more components of the compressor 105.

In some implementations, the first component (which is electrochemically active) includes hydrogen ($H_2$) and the second component (which is a condensable refrigerant) includes carbon dioxide ($CO_2$). In this implementation, the components are present in the proportion of approximately one part hydrogen and four parts of carbon dioxide by volume. The relative proportions of hydrogen and carbon dioxide are governed by the desired relative efficiency of the electrochemical compressor 105 and the system 300. The quantity of water maintained in the working fluid is governed by the thickness of membranes employed in the compressor 105, the equivalent weight (acidity) of the ion exchange media employed in the compressor 105, and the amount of hydrogen in the system 300. Thinner membranes of higher equivalent weight (that is, lower acidity) employed in systems with lower proton capability require less water. In general, the working fluid includes less than 50% of water, but can include less than 20%, less than 10%, or less than 1% water, depending on the application.

While hydrogen is used primarily as the electrochemically-active component of the working fluid, hydrogen also possesses useful heat transfer properties. Hydrogen's low density, high specific heat, and thermal conductivity make it a superior coolant. Hydrogen gas can be used as the heat transfer medium industrially in, for example, turbine generators. The presence of hydrogen gas within the working fluid thus enhances the performance of the condensable refrigerant; and provides thermal exchange opportunities at points away from thermally conductive surfaces of the fluid conduits and the heat transfer devices.

The first heat transfer device 310 includes an evaporator that places the working fluid in a heat exchange relationship with the first heat reservoir or source of heat (for example, a source fluid). The first heat transfer device 310 includes inlet and outlet ports coupled to respective conduits 311, 312 that contain the working fluid of the system 300. The second heat transfer device 315 includes a condenser that places the working fluid in a heat exchange relationship with the second heat reservoir or heat sink (for example, a sink fluid). The second heat transfer device 315 includes inlet and outlet ports coupled to respective conduits 316, 317 that contain the working fluid of the system 300.

The expansion valve 320 is an orifice that controls the amount of working fluid flow. The valve 320 can include a temperature sensing bulb filled with a similar gas as in the working fluid that causes the valve to open against the spring pressure in the valve body as the temperature on the bulb increases. As the temperature in the evaporator 310 decreases, so does the pressure in the bulb and therefore the pressure on the spring, causing the valve to close.

The control system 135 is coupled to the compressor 105, the first heat transfer device 310, and the second heat transfer device 315. The control system 135 is also coupled to one or more temperature sensors 325, 330, 340, 345 placed within the system 300 to monitor or measure the temperature of various features of the system 300. For example, the temperature sensor 325 can be configured to measure the temperature of the working fluid within the conduit 311 and the temperature sensor 330 can be configured to measure the temperature of the working fluid within the conduit 317. As another example, temperature sensors 340, 345 can be placed near respective heat transfer devices 310, 315 to measure the temperature at which the heat transfer device operates, to measure the temperature of the working fluid within the respective heat transfer device, or to measure the heat source fluid temperature or heat sink fluid temperature.

The refrigeration system 300 can also include, though does not necessarily require, one-way valves 360, 362 at the output of the compressor 105. Each of the one-way valves 360, 362 can be a mechanical device, such as a check valve, that normally allows fluid (that is, liquid or gas) to flow through it in only one direction (the direction away from the compressor 105 and toward the tubular system 110). The valves 360, 362 ensure proper delivery of the components of the working fluid that exit the compressor 105 into the rest of the refrigeration system 300 by reducing or avoiding back-pressure into the last cell in the compressor 105, and therefore ensure unidirectional flow of the fluids (which include gases). For example, the valve 360 is placed within a conduit 350 that transports the higher pressure electrochemically-active component plus the small amount of water that is involved in the electrochemical process and the valve 362 is placed within a conduit 352 that transports the lower pressure condensable refrigerant that bypasses the electrochemical process.

The refrigeration system 300 can also include a dryer 370 that is configured to remove water from the working fluid prior to reaching the expansion valve 320 to reduce the chance of water freezing within the valve 320 and potentially clogging the valve 320, and to increase the efficiency of the expansion process within the valve 320.

The system 300 includes an electrochemical cell of the compressor 105 that compresses an electrochemically-active component of the working fluid, and remixes the compressed (at high pressure) electrochemically-active component (the first component) with the condensable refrigerant (the second component) to elevate the pressure of the mixed gas working fluid in a vapor compression refrigeration cycle. In this way, the electrochemical compressor 105 is capable of producing high pressure hydrogen gas from a mixed component working fluid having an electrochemically-active component such as, hydrogen and at least one condensable refrigerant. In this arrangement, hydrogen is compressed to a much higher pressure than the final working fluid pressure (that is, the pressure of the remixed working fluid), and because of this, the hydrogen when mixed with the lower pressure condensable refrigerant is at the required higher pressure. The exact pressure requirements for the hydrogen stream depends on the volume of condensable refrigerant being pressurized in relation to the volume of hydrogen, the desired final pressure requirements of the remixed working fluid, and the targeted energy efficiency. The tubular system 110 is employed to make sure the gas flows are maintained in the intended directions and that no back flow is allowed towards the cells of the compressor 105.

Figure 4A:
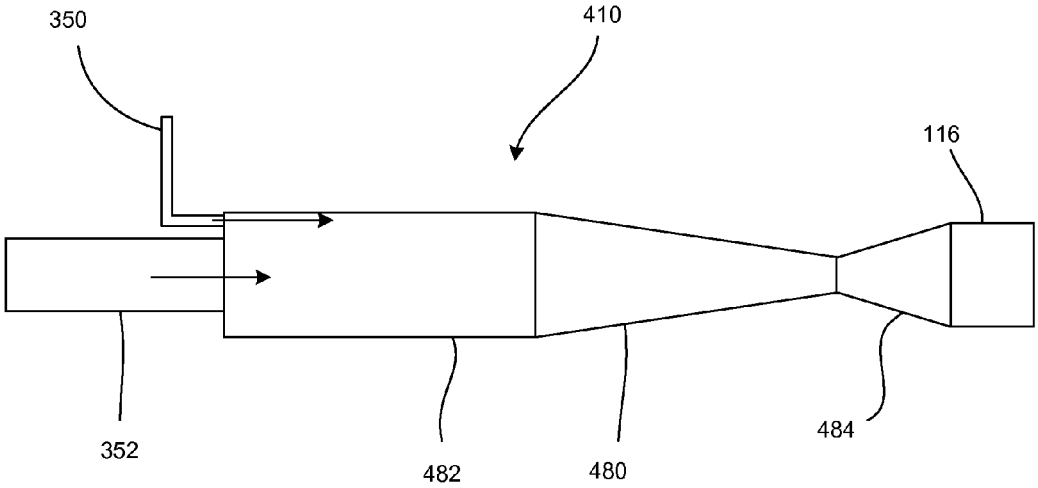
FIGS. 4A and 4B are block diagrams of exemplary tubular systems used in the heat transfer system of FIG. 1.
Figure 4B:
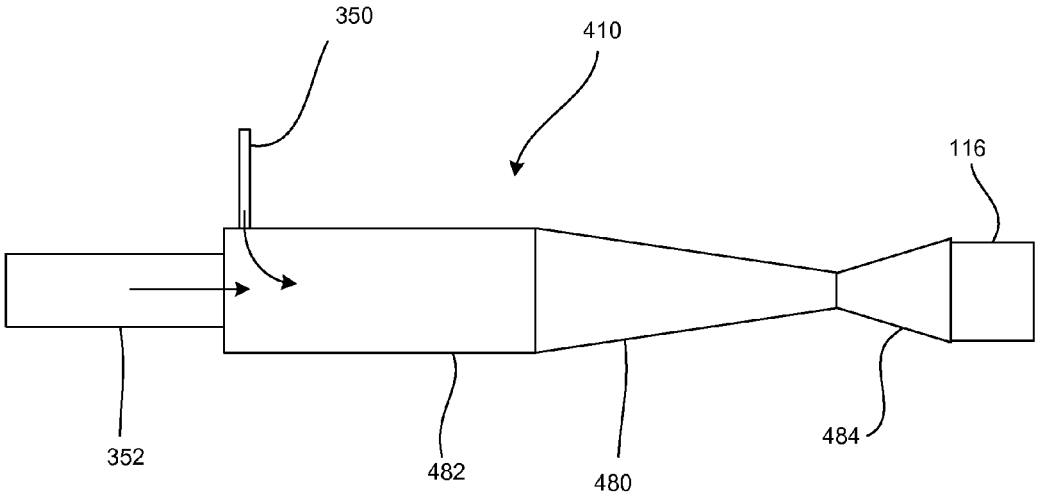

Referring also to FIGS. 4A and 4B, the refrigeration system 300 includes as the tubular system 110 a Venturi tube 410 that receives low-pressure fluid (the unpressurized condensable refrigerant) 442 from the conduit 352 and high-pressure fluid (the pressurized electrochemically-active component plus any other components that travel through the condenser 105) 440 from the conduit 350.

The Venturi tube 410 includes at least one convergent nozzle 480 following a cylinder 482. The Venturi tube 410 can also include a divergent nozzle 484 following the convergent nozzle 480. The Venturi tube 410 is configured to mix the low-pressure fluid 442 with the high-pressure fluid 440 to enable a transfer of kinetic energy from the high-pressure fluid 440 to the low-pressure fluid 442. Additionally, the Venturi tube 410 is also inherently configured to increase the kinetic energy of the low-pressure fluid 442 as it enters the convergent nozzle 480; because of the Bernoulli effect, the fluid 442 is supplied with energy by a pressure gradient force from behind as it enters the convergent nozzle 480, thus providing an increase in kinetic energy (and therefore velocity) of the fluid 442 as it passes through the convergent nozzle 480. Moreover, the fluids 440, 442 leaving the convergent nozzle 480 are mixed together and slowed a bit as they enter the divergent nozzle 484. By the time the fluids 440, 442 exit the divergent nozzle 484 and the Venturi tube 410, they are more fully mixed together, with the low-pressure fluid 442 that exits noticing an increase in kinetic energy relative to the low-pressure fluid 442 that enters. In this way, the Venturi tube 410 enables a successful mixing between the low-pressure fluid 442 and the high-pressure fluid 440 that prevents or reduces the chance that the fluids 440, 442 are directed back into the compressor 105.

FIG. 4A shows the conduit 350 coupled to the tube 410 axially while FIG. 4B shows the conduit 350 coupled to the tube 410 tangentially. In each of these designs, the fluids 440, 442 may mix at different locations along the path through the cylinder 482 and the convergent nozzle since the fluid 440 would be entering the cylinder 482 along different paths.

Figure 5:
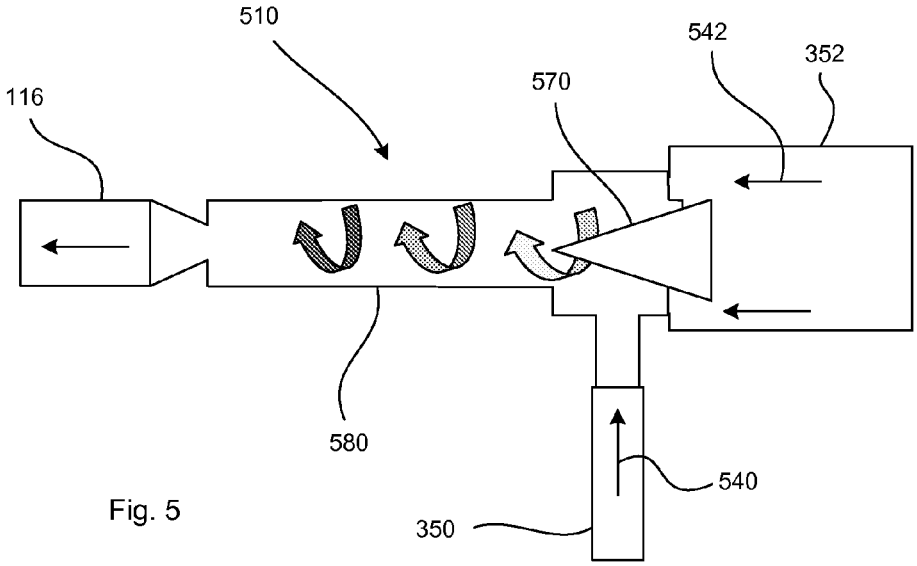
FIG. 5 is a block diagram of an exemplary tubular system used in the heat transfer system of FIG. 1.

Referring also to FIG. 5, in another implementation, the refrigeration system 300 includes as the tubular system 110 a vortex tube 510 that receives low-pressure fluid (the condensable refrigerant) 542 from the conduit 352 and high-pressure fluid (the electrochemically-active component plus any other components that travel through the condenser 105) 540 from the conduit 350. The low-pressure fluid is injected tangentially into a swirl chamber 580 and the high-pressure fluid is injected around a conical nozzle 570. In this case, the high-pressure fluid 540 rotates along the swirl chamber 580 and decreases in angular momentum, transferring its kinetic energy to the outer rotating low-pressure fluid 542. The fluids intermingle in the swirl chamber 580.

The vortex tube 510 does not have any moving parts and it operates by imparting a rotational (vortex) motion to an incoming compressed air stream; this is done by directing compressed air into an elongated and cylindrical channel in a tangential direction. A vortex tube 510 includes on its interior an aerodynamic surface in that it is designed to reduce or minimize the drag caused by a fluid moving through it. The conical nozzle 570 within its interior causes a separation of fluids depending on its position. Therefore, although the vortex tube 510 lacks moving parts, a position of the conical nozzle 570 can be adjusted axially since such an adjustment changes a ratio of mixing of the fluids, and also changes outlet temperatures of the fluids.

Figure 6:
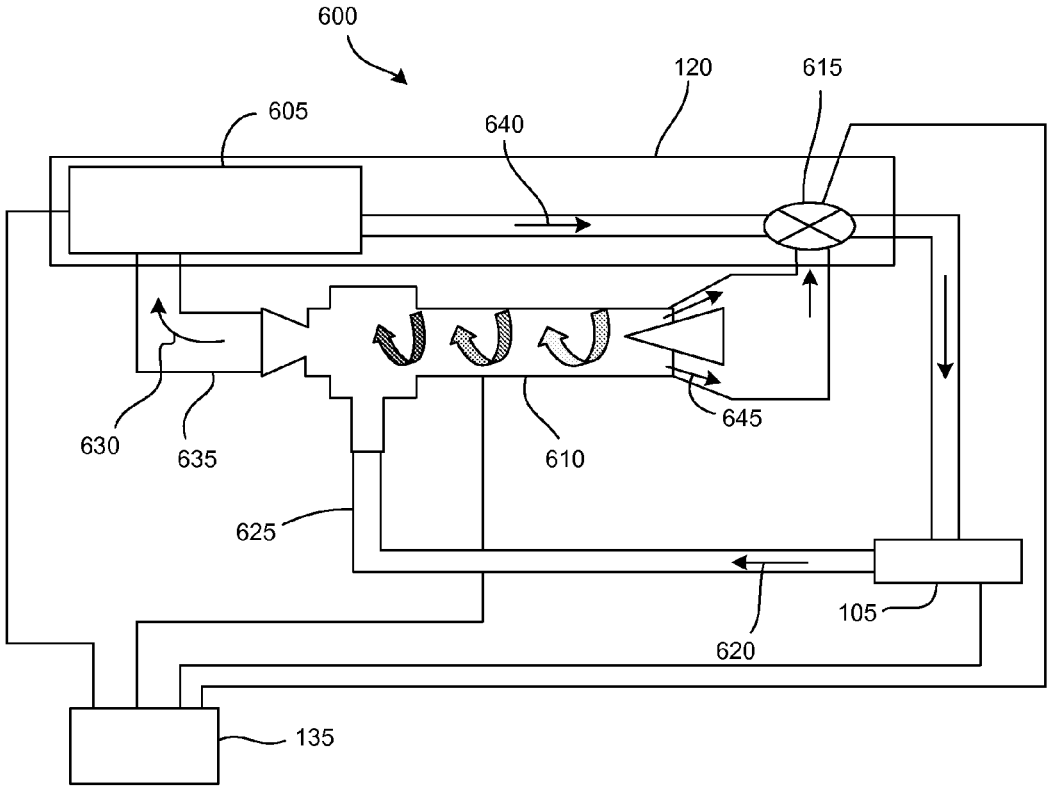
FIG. 6 is a block diagram of an exemplary heat transfer system of FIG. 1 that is a heat exchange system.

In some implementations, the heat transfer system 100 is a heat exchange system 600, as shown in FIG. 6. In this case, the heat transfer components 120 include a heat exchanger 605 and a mixing device 615. The mixing device 615 can be a three-way valve that allows two fluids to enter through two separate ports, then mix the two fluids and output the mixed fluid through a third port. The heat exchange system 600 includes as the tubular system 110 a vortex tube 610. The vortex tube 610 receives a compressed working fluid (for example, hydrogen) 620 from the electrochemical compressor 105 through a conduit 625 and outputs a cold gas exhaust 630 through an output conduit 635 to the heat exchanger 605. The heat exchanger 605 receives the cold gas exhaust 630 and uses the cold gas exhaust 630 to cool a heat source by placing the cold gas exhaust 630 and a heat source fluid in thermal contact (either direct or indirect) with each other. The warmed gas exhaust 640 from the heat exchanger 605 and a hot gas exhaust 645 from the vortex tube 610 are combined or mixed in the mixing device 615 and the output from the mixing device 615 is directed into the compressor 105, where the process begins over again. In the heat exchange system 600, the vortex tube 610 is used solely with one working component fluid (for example, hydrogen) and is used with a purpose of generating a gas stream exhaust at one side for cooling purposes and/or a hot gas stream on the other side optionally for heating purposes. The control system 135 is connected to one or more of the heat exchanger 605, the vortex tube 610, the compressor 105, and the mixing device 615 to receive information about the system 600 and control operation of the components within the system 600. For example, the control system 135 can regulate the inlet and outlet ports of the mixing device 615 to control the amount of fluids mixed and output to the compressor 105.

In some implementations, heat-sinking the whole vortex tube 510 or 610 can be helpful. Moreover, vortex tubes 510, 610 can also be cascaded, that is, arranged in series with each other along the fluid flow direction.

Thus, in summary, the tubular system 110 mixes pressurized hydrogen gas from the cathode of the electrochemical cell compressor 105 either on its own (as shown in FIG. 6) or optionally with a working fluid component (unpressurized condensable refrigerant) (as shown in FIGS. 3 and 4) exiting the anode for refrigeration cycle applications. The tubular system 110 therefore enables the mixing of gases exiting the anode and the cathode of the electrochemical compressor to impart good energy transfer between the two gases without blow back. Additionally, the tubular system 110 enables the transfer of pressure or energy from a pressurized gas stream exiting an electrochemical cell and an unpressurized gas stream exiting the same electrochemical cell's opposite electrode.

The heat transfer system 100 can work with a wide range of work fluids. However the choice of the working fluid depends on the application under consideration and other external regulatory factors.

In some implementations, the vortex tube 510, 610 is a vortex tube model number 106-2-H (57 SLPM) from Vortec Division of ITW Air Management, Cincinnati, Ohio that is combined with a 4Hm-series hydrogen generator producing pressurized hydrogen from electrolysis (which can simulate the performance of an electrochemical compressor) to produce 100 BTUH cooling effect.

In some implementations such as that shown in FIG. 6, the electrochemical compressor 105 is a 10 cm×10 cm cell that produces pressurized hydrogen, and is combined with the vortex tube 610 directly to produce cooling and heating gas streams, which are then recombined and fed back into the electrochemical cell of the compressor 105.

Figure 7:
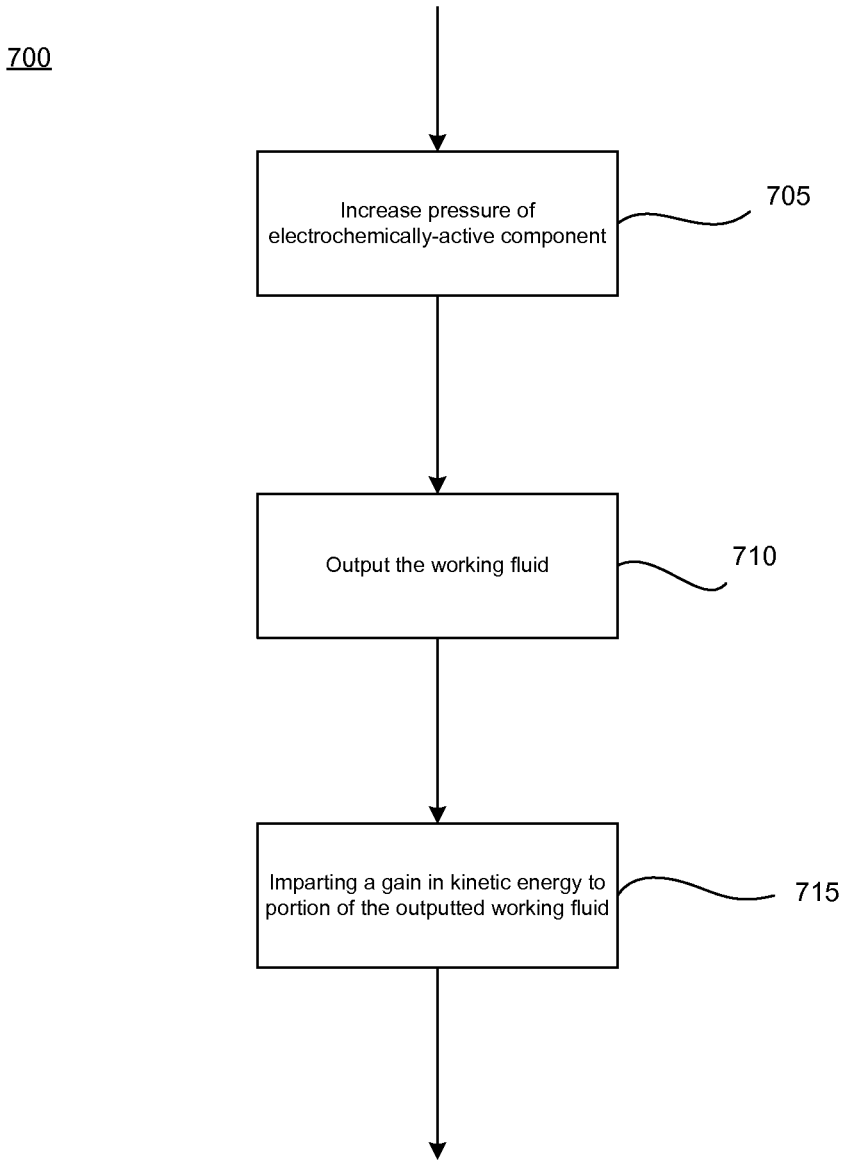
FIG. 7 is a flow chart of a procedure performed by the heat transfer system of FIG. 1.

Referring to FIG. 7, a procedure 700 is performed for transferring heat using a working fluid that is circulated through and contained within a closed loop of the heat transfer system 100 of FIGS. 1 and 2. Initially, a pressure of at least one electrochemically-active component of the working fluid is increased (step 705). The pressure of the electrochemically-active component is increased by circulating the electrochemically-active component through the electrochemical compressor 105 and outputting the pressurized electrochemically-active component. The working fluid including the pressurized electrochemically-active component and, if present, other components of the working fluid that bypass the electrochemical compressor 105 are outputted (step 710), for example, to the tubular system 110. The tubular system 110, which is a body of revolution, imparts a gain in kinetic energy to at least a portion of the outputted working fluid due to its geometry (step 715).

Figure 8:
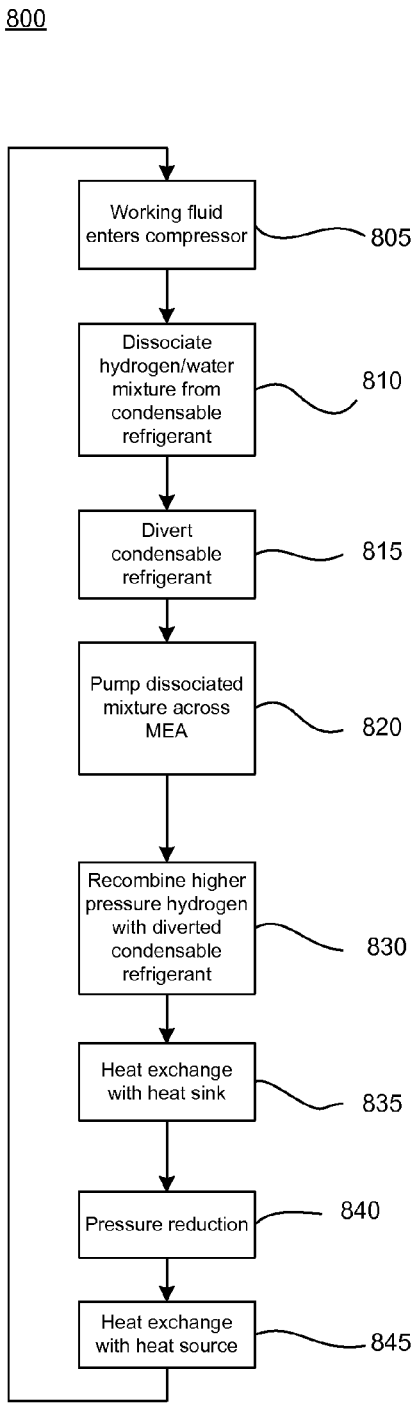
FIG. 8 is a flow chart of a procedure performed by the refrigeration system of FIG. 3.

The general procedure 700 is performed as a part of a heat transfer procedure that uses all of the components (such as the heat transfer components 120) of the heat transfer system 100. For example, with reference to FIG. 8, the refrigeration system 300 performs a procedure 800 for transferring heat from a heat source (for example, at the first heat transfer device 310 of the system 300) to the heat sink (for example, at the second heat transfer device 315 of the system 300).

Low pressure (that is, unpressurized) working fluid (which is typically a gas mixture of hydrogen, condensable refrigerant, and water) enters the compressor 105 (step 805). A mixture of hydrogen and water is dissociated from the condensable refrigerant (step 810). In particular, the hydrogen (in the form of a proton) and water dissolve into the ion exchange media while the condensable refrigerant does not. The condensable refrigerant is diverted along a path separate from the electrochemical path through the membrane electrode assembly (step 815). The dissociated mixture is then pumped across the membrane electrode assembly of each cell in the compressor 105 (step 820). In particular, electrons are stripped from the hydrogen in the hydrogen/water mixture at the anode collector of the cell, and the hydrogen ions are transported across the anode, electrolyte, and toward the cathode due to the electrical potential applied across the collectors from the power supply. Additionally, the hydrogen ion gas is pressurized across the membrane electrode assembly. Next, the hydrogen ions are recombined with the electrons at the cathode collector to reform hydrogen gas at a higher pressure, and this higher pressure hydrogen gas is recombined with the diverted condensable refrigerant to thereby raise the pressure of the working fluid (step 830) for example, by directing the diverted condensable refrigerant and the pressurized mixture exiting the compressor 105 through the tubular system 110.

Thus, the electrochemical compressor 105 raises the pressure of the working fluid and delivers the higher pressure working fluid to the second heat transfer device (the condenser) 315 where the condensable refrigerant is precipitated by heat exchange with the sink fluid (step 835). The working fluid is then reduced in pressure in the expansion valve 320 (step 840). Subsequently, the low pressure working fluid is delivered to the first heat transfer device (the evaporator) 310 where the condensed phase of the working fluid is boiled by heat exchange with the source fluid (step 845). The evaporator effluent working fluid may be partially in the gas phase and partially in the liquid phase when it is returned from the evaporator to the electrochemical compressor 105. In the process, heat energy is transported from the evaporator to the condenser and consequently, from the heat source at a relatively lower temperature to the heat sink at relatively higher temperature.

Figure 9:
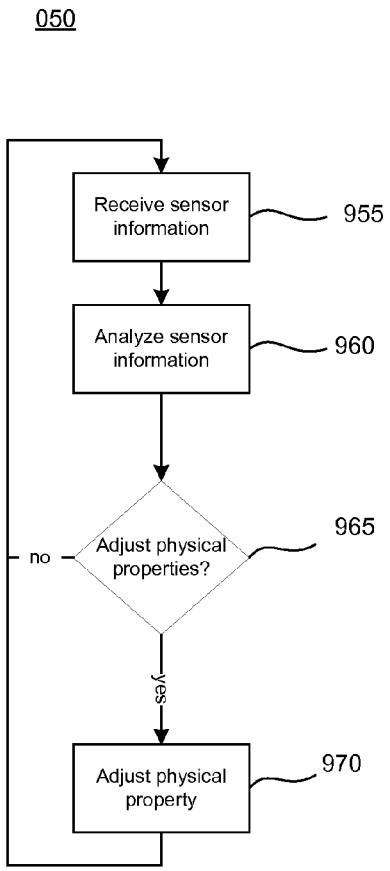
FIG. 9 is a flow chart of a procedure performed by a control system within the refrigeration system of FIG. 3.

Referring also to FIG. 9, concurrently with the procedure 800, the control system 135 performs a procedure 950 for controlling the amount of electrical potential applied to the current collectors of the compressor 105, and therefore also controlling the amount of heat energy transported from the evaporator to the condenser. The control system 135 receives information from the one or more sensors (for example, temperature or pressure sensors) in the system 300 indicating physical characteristics (such as temperature or pressure) at key locations of the system 300 (step 955). The control system 135 analyzes the information (step 960) and determines whether physical properties of the system 300 need to be adjusted based on the analyzed information (step 965). For example, the control system 135 can determine that a current applied to the compressor 105 (and therefore the current applied to the electrode collectors) needs to be adjusted. As another example, the control system 135 can determine that a flow rate of one or more of the heat sink fluid and the heat source fluid that transport heat from and to the devices 315, 310 needs to be adjusted. If the control system 135 determines that a physical property of the system 300 should be adjusted, then the control system 135 sends a signal to the component that is affected to adjust the particular property (step 970). For example, the control system 135 can send a signal to the power supply to adjust the amount of current applied to the current collectors in the compressor 105. Otherwise, the control system 135 continues to receive information from the one or more sensors (step 955).

The energy efficiency of the system 100 depends on the available surface area of the anode 205 and the cathode 210, and the current density and operating voltage applied to the cells from the power supply. Higher current densities result in greater the resistive losses for the system 100.

The size reduction of the compressor 105 is feasible because of its cellular design, and because it is operating using an electrochemical process. If an application requires significant size reductions, the electrode (the anode and the cathode) surfaces can be reduced, the applied current densities and voltages can be increased, and as a result a smaller mass of cells can be employed in the compressor 105. This would result in an almost order of magnitude reduction in size and weight for the system 100 compared to conventional mechanical systems.

Since cooling capacity is linked to applied current and voltage, one advantage of this system is that it can more easily modulate from low capacity (that is, low current density at a specific voltage) to a high capacity. A system 100 designed to operate at high capacities actually becomes more efficient at lower utilizations, while, the opposite is true for mechanical systems.

What is claimed is:

1. A heat transfer system defining a closed loop that contains a working fluid that is circulated through the closed loop, the heat transfer system comprising:

an electrochemical compressor including one or more electrochemical cells electrically connected to each other through a power supply, each electrochemical cell comprising a gas pervious anode, a gas pervious cathode, an electrolyte disposed between and in intimate electrical contact with the cathode and the anode, an electrochemical compressor input, an electrochemical compressor output, and wherein at least one of said one or more electrochemical cells comprises an electrochemical compressor bypass conduit; and a tubular system that receives at least one electrochemically-active component of the working fluid from said electrochemical compressor output and other components of the working fluid from said electrochemical compressor bypass conduit, wherein the tubular system has a geometry that enables at least a portion of the received working fluid to be imparted with a gain in kinetic energy as it moves through the tubular system.

2. The system of claim 1, wherein the tubular system is configured to prevent the working fluid portion from flowing back into the electrochemical compressor.

3. The system of claim 1, wherein the heat transfer system comprises:

a first heat transfer device that transfers heat from a first heat reservoir to the working fluid; and a second heat transfer device that transfers heat from the working fluid to a second heat reservoir.

4. The system of claim 3, wherein the first heat reservoir is at a lower temperature than the second heat reservoir.

5. The system of claim 3, wherein the electrochemical compressor is between the first and second heat transfer devices.

6. The system of claim 3, wherein the first heat transfer device includes an evaporator and the second heat transfer device includes a condenser.

7. The system of claim 3, further comprising an expansion valve between the first and second heat transfer devices and configured to reduce a pressure of the working fluid.

8. The system of claim 1, wherein the electrochemical compressor output is a cathode output that receives the electrochemically-active component after it has been pressurized.

9. The system of claim 8, wherein the electrochemical compressor includes an anode at which the other working fluid components exit the electrochemical compressor without being pressurized.

10. The system of claim 9, wherein the tubular system is configured to mix the un-pressured working fluid components with the pressurized electrochemically-active component.

11. The system of claim 9, wherein the tubular system is configured to transfer kinetic energy from the pressurized electrochemically-active component to the un-pressured working fluid components.

12. The system of claim 1, wherein the other working fluid components include a condensable refrigerant component that bypasses the electrochemical process.

13. The system of claim 1, further comprising a heat sink in thermal contact with the tubular system.

14. The system of claim 1, wherein the tubular system includes a venturi tube.

15. The system of claim q, wherein the tubular system includes a vortex tube.

16. The system of claim 1, wherein the tubular system is configured to receive all of the components of the working fluid from the electrochemical compressor.

17. A method of transferring heat using a working fluid that is circulated through and contained within a closed loop, the method comprising:

providing an electrochemical compressor including one or more electrochemical cells electrically connected to each other through a power supply, each electrochemical cell comprising a gas pervious anode, a gas pervious cathode, an electrolyte disposed between and in intimate electrical contact with the cathode and the anode, an electrochemical compressor input, an electrochemical compressor output, and wherein at least one of said one or more electrochemical cells comprises an electrochemical compressor bypass conduit;

increasing a pressure of said at least one electrochemically-active component of said working fluid by circulating said electrochemically-active component through said electrochemical compressor and outputting a pressurized electrochemically-active component to said electrochemical compressor output;

outputting the working fluid including said pressurized electrochemically-active component and other components of the working fluid that bypass the electrochemical compressor to a tubular system wherein the tubular system has a geometry that enables at least a portion of the received working fluid to be imparted with a gain in kinetic energy as it moves through the tubular system; and imparting a gain in kinetic energy to at least a portion of the outputted working fluid by directing the outputted working fluid through a body of revolution.

18. The method of claim 17, wherein increasing the pressure of the electrochemically-active working fluid component comprises:

electrochemically ionizing the electrochemically-active component by stripping charged particles from the electrochemically-active component, enabling the ionized electrochemically-active component to pass through an electrolyte, pumping the charged particles to create an electric potential gradient across the electrolyte, pumping the ionized electrochemically-active component across the electrolyte using the electric potential gradient, electrochemically de-ionizing the electrochemically-active component by combining the pumped charged particles with the ionized electrochemically-active component, and pressuring the de-ionized electrochemically-active component.

19. The method of claim 17, further comprising dissociating the electrochemically-active component from a condensable refrigerant component within the working fluid to enable the condensable refrigerant component to bypass the electrochemical compressor.

20. The method of claim 17, further comprising conveying heat from a first heat reservoir at a relatively low temperature to a second heat reservoir at relatively high temperature by circulating the working fluid through a closed loop that is thermally coupled to the first heat reservoir at a first portion and is thermally coupled to the second heat reservoir at a second portion.

21. The method of claim 20, wherein conveying the heat comprises: transferring heat from the working fluid at the second loop portion to the second heat reservoir including liquefying at least some of the working fluid; reducing a pressure of the at least partially liquefied working fluid by expanding the working fluid at a substantially constant enthalpy; and transferring heat from the first heat reservoir to the working fluid at the first loop portion including vaporizing at least some of the working fluid.

22. The method of claim 17, wherein, if other working component components that bypass the electrochemical compressor are present, then the method comprises re-associating the pressurized electrochemically-active component with the condensable refrigerant component by imparting the gain in kinetic energy to the outputted working fluid portion to form a pressurized working fluid.

23. The method of claim 17, wherein imparting the gain in kinetic energy to the outputted working fluid portion comprises reducing an amount of working fluid from flowing back into the electrochemical compressor.

24. The method of claim 17, further comprising, if other components of the working fluid that bypass the electrochemical compressor are present, then mixing the pressurized electrochemically-active component with the other components.

25. The method of claim 17, wherein, if other components of the working fluid that bypass the electrochemical compressor are present, then kinetic energy is imparted to the outputted working fluid portion by transferring kinetic energy from the pressurized electrochemically-active component to the other components.

26. The method of claim 17, wherein imparting the gain in kinetic energy includes directing the outputted working fluid through a Venturi tube.

27. The method of claim 17, wherein imparting the gain in kinetic energy includes directing the outputted working fluid through a vortex tube.

* * * * *